US005226746A

United States Patent [19]

Johnson

[11] Patent Number: 5,226,746

[45] Date of Patent: Jul. 13, 1993

[54] BOAT LIFT APPARATUS

[76] Inventor: Roy V. Johnson, P.O. Box 168, Philo, Ill. 61864

[21] Appl. No.: 944,284

[22] Filed: Sep. 14, 1992

[51] Int. Cl.[5] ..... B63C 3/06

[52] U.S. Cl. ..... 405/3; 114/48; 405/1

[58] Field of Search ..... 405/1, 3, 4, 7, 218, 405/221; 114/44, 45, 48; 414/678

[56] References Cited

U.S. PATENT DOCUMENTS 4,686,920 8/1987 Thomas ..... 405/3
4,773,346 9/1988 Blanding et al. ..... 114/45
4,787,327 11/1988 Porter ..... 114/44
4,832,210 5/1989 Wood ..... 405/3 X
4,954,011 9/1990 Stenson ..... 405/3
4,983,067 1/1991 Montgomery ..... 405/3
5,037,237 8/1991 Anteau ..... 405/3

*Primary Examiner*—David H. Corbin
*Attorney, Agent, or Firm*—Leon Gilden

[57] ABSTRACT

A boat lift is arranged to include spaced rectilinear frameworks having leg members splayed exteriorly of a first framework extending to the second framework. The legs may optionally include telescoping extensions, with the extensions and legs having foot plates for mounting the frameworks to a support surface. Flexible webs are mounted at opposed ends between the frameworks to position and lift a boat therebetween.

5 Claims, 4 Drawing Sheets

BOAT LIFT APPARATUS

BACKGROUND OF THE INVENTION

1. Field of the Invention

The field of invention relates to boat lift apparatus, and more particularly pertains to a new and improved boat lift apparatus wherein the same is arranged for the lifting and positioning of a boat relative to a body of water.

2. Description of the Prior Art

Various boat lift apparatus of various types have been utilized throughout the prior art and exemplified in U.S. Pat. Nos. 4,832,210; 4,861,218; 4,954,011; and 4,983,067.

The instant invention attempts to overcome deficiencies of the prior art by providing for a boat lift structure wherein the thermal conductive frameworks of the boat lift structure is positioned within a body of water and upon an underlying support surface, wherein in particularly geographic areas having icing conditions, the thermal conductive structure of the invention minimizing freezing thereabout utilizing the water supporting bottom as well as lower portions of the water to prevent freezing around the structure of the invention and in this respect, the present invention substantially fulfills this need.

SUMMARY OF THE INVENTION

In view of the foregoing disadvantages inherent in the known types of boat lift apparatus now present in the prior art, the present invention provides a boat lift apparatus wherein the same is addressed to the manipulation of a boat within a body of water. As such, the general purpose of the present invention, which will be described subsequently in greater detail, is to provide a new and improved boat lift apparatus which has all the advantages of the prior art boat lift apparatus and none of the disadvantages.

To attain this, the present invention provides a boat lift arranged to include spaced rectilinear frameworks having leg members splayed exteriorly of a first framework extending to the second framework. The legs may optionally include telescoping extensions, with the extensions and legs having foot plates for mounting the frameworks to a support surface. Flexible webs are mounted at opposed ends between the frameworks to position and lift a boat therebetween.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved boat lift apparatus which has all the advantages of the prior art boat lift apparatus and none of the disadvantages.

It is another object of the present invention to provide a new and improved boat lift apparatus which may be easily and efficiently manufactured and marketed.

It is a further object of the present invention to provide a new and improved boat lift apparatus which is of a durable and reliable construction.

An even further object of the present invention is to provide a new and improved boat lift apparatus which is susceptible of a low cost of manufacture with regard to both materials and labor, and which accordingly is then susceptible of low prices of sale to the consuming public, thereby making such boat lift apparatus economically available to the buying public.

Still yet another object of the present invention is to provide a new and improved boat lift apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
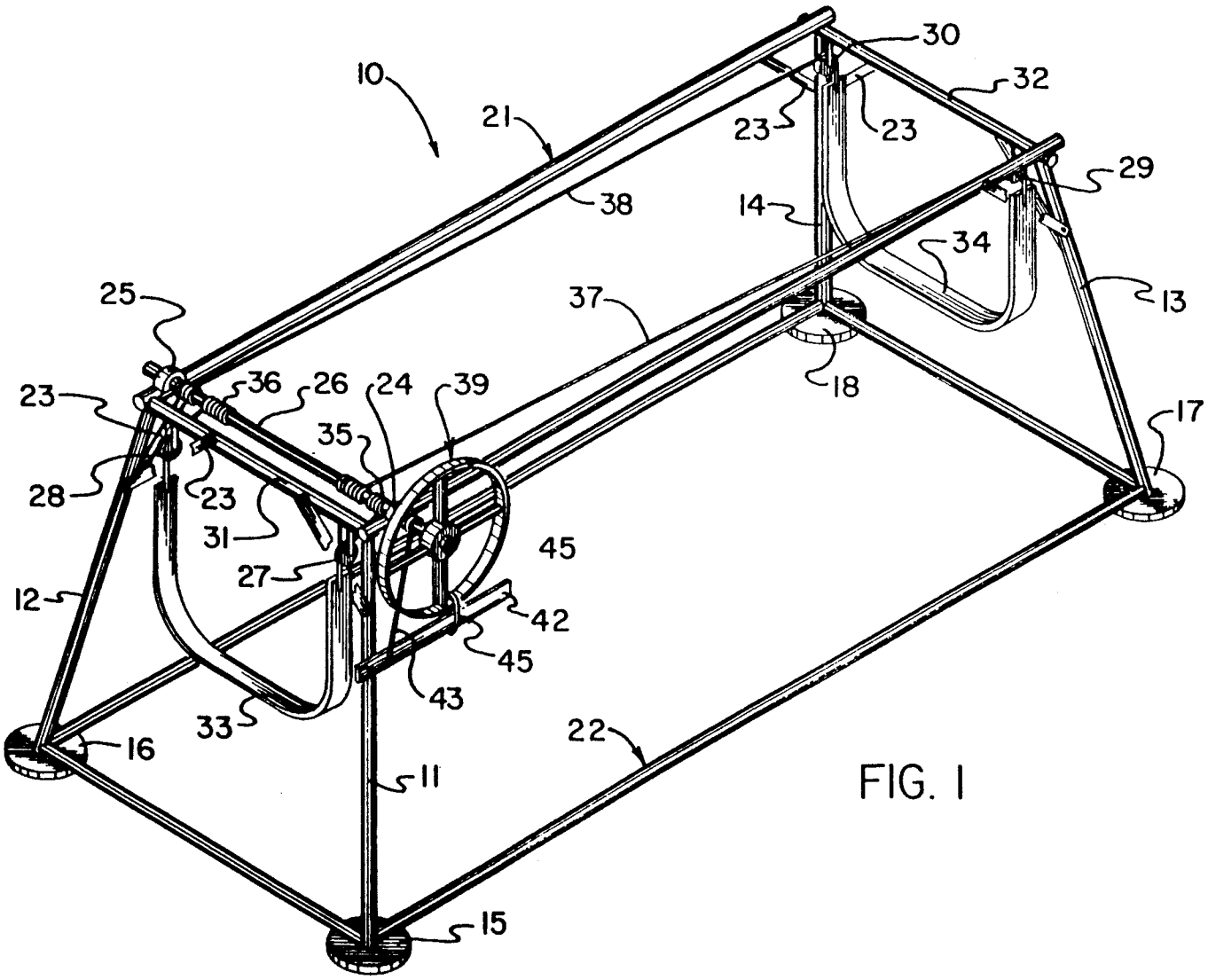
FIG. 1 is an isometric illustration of the instant invention.
Figure 2:
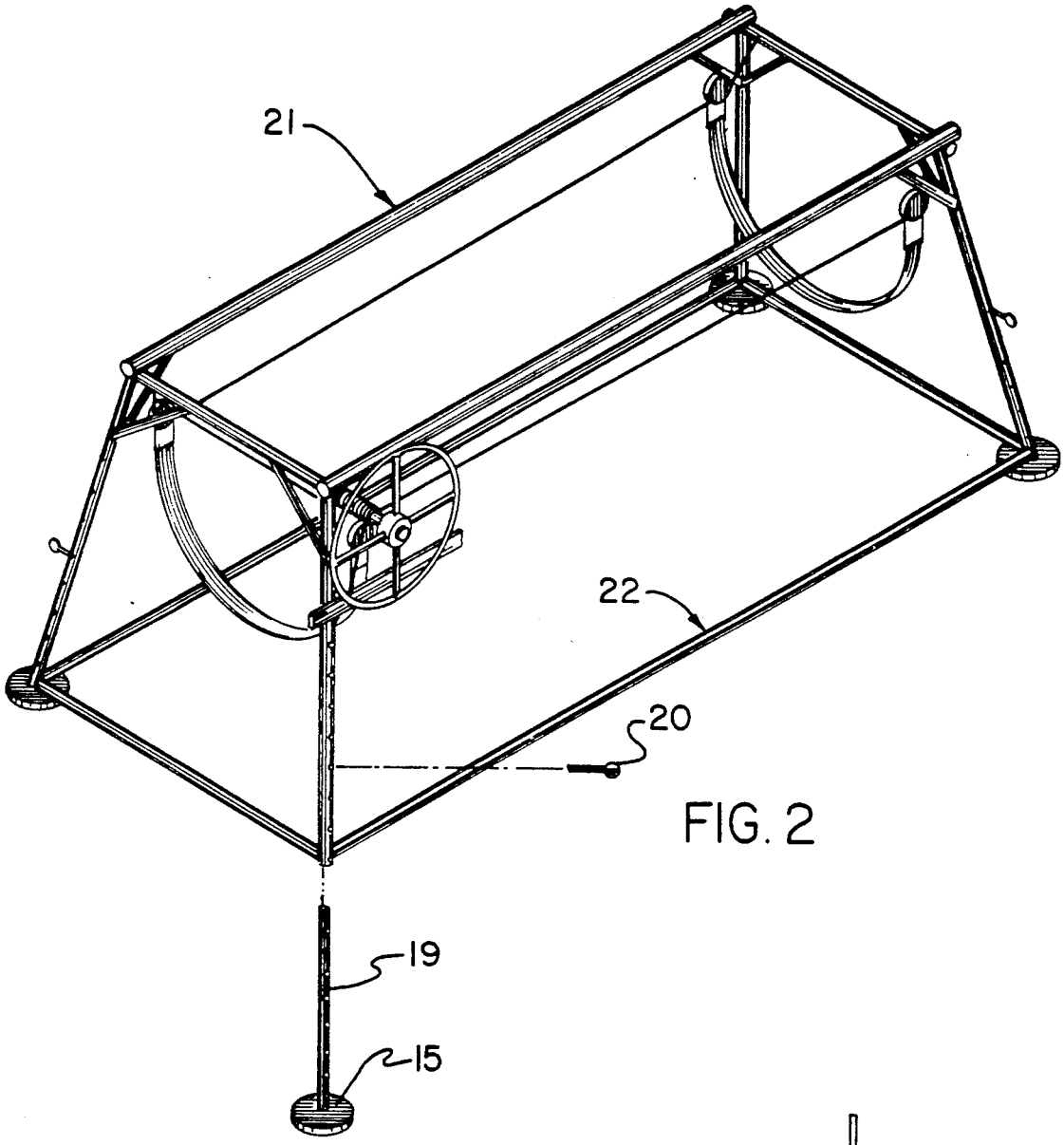
FIG. 2 is an isometric illustration of the invention illustrating the use of telescoping legs.

With reference now to the drawings, and in particular to FIGS. 1 to 5 thereof, a new and improved boat lift apparatus embodying the principles and concepts of the present invention and generally designated by the reference numeral 10 will be described.

Figure 3:
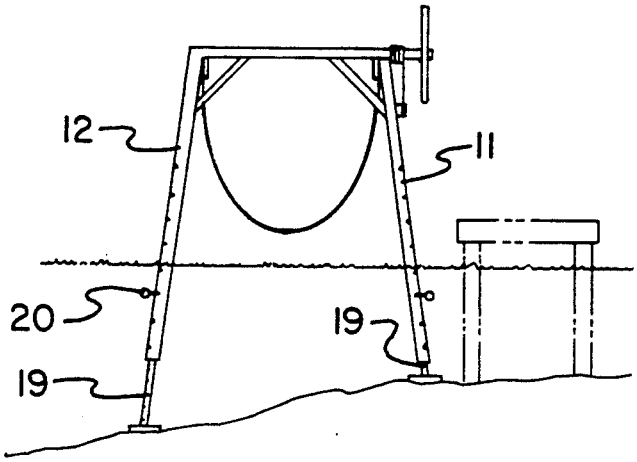
FIG. 3 is an orthographic side view of the invention illustrating the lift structure mounted within an uneven support surface.
Figure 4:
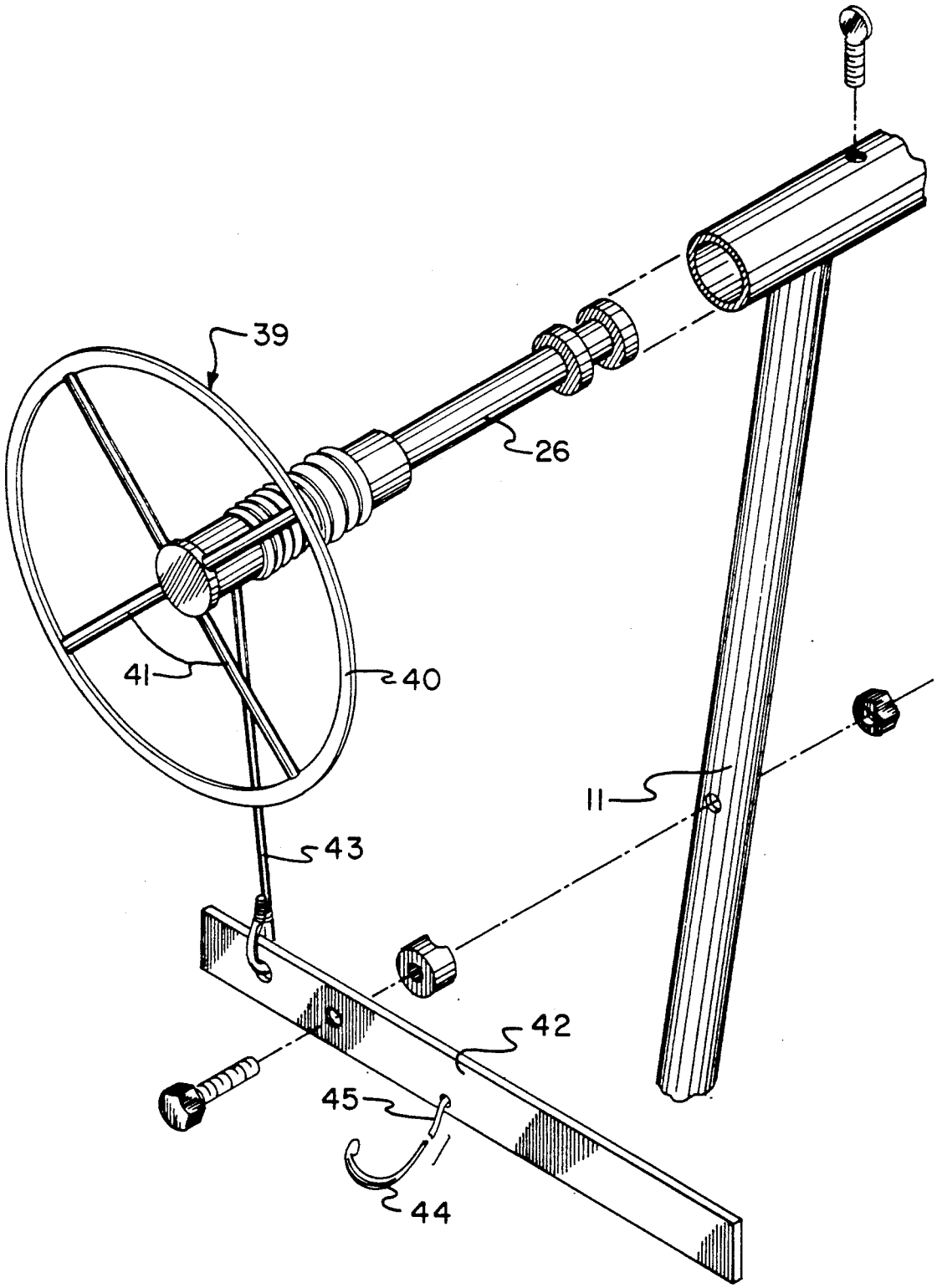
FIG. 4 is an enlarged isometric illustration in exploded view of the control wheel structure of the invention.

More specifically, the boat lift apparatus 10 of the instant invention essentially comprises a first rectilinear framework 21 spaced from and parallel a second rectilinear framework 22 and positioned thereover medially of the second rectilinear framework 22. Respective first, second, third, and fourth support legs 11, 12, 13, and 14 are splayed exteriorly of the first rectilinear framework and extend downwardly thereto for integral communication with the second rectilinear framework. The legs are fixedly mounted to aligned corner portions of each of the frameworks, wherein typically each framework includes first through fourth corner portions. In this manner, stability is imparted to the structure when mounted to an underlying surface, as indicated in FIG. 3. Further to accommodate various irregularities in an underlying support, a telescoping leg 19 is telescopingly mounted and projecting exteriorly of each of the support legs below the second framework. The first through fourth support legs each include an associated telescoping leg 19, as indicated in the FIGS. 2 and 3, with each telescoping leg having a latch 20 to secure a telescoping leg relative to an associated support leg. In this manner, each support leg and associated telescoping leg may be adjustably projected relative to one another to accommodate various irregularities at each corner of the apparatus 10.

Figure 5:
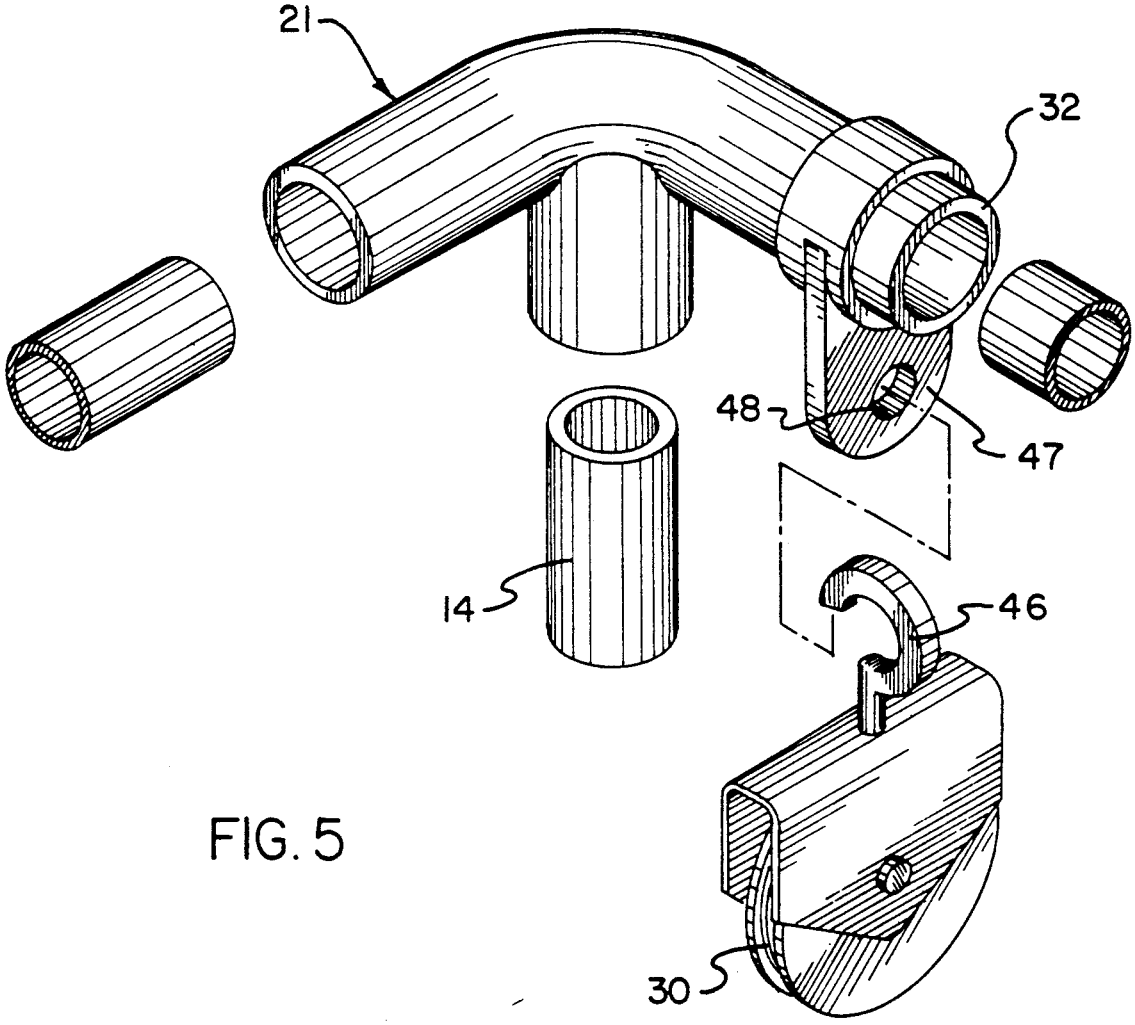
FIG. 5 is an isometric illustration illustrating typical mounting of a pulley member of the invention.

The first framework includes first and second side legs, with the first side leg having a first bearing mount 24, the second side leg having a second bearing mount 25. The first and second bearing mounts are coaxially aligned relative to one another and rotatably receive a lift shaft 26 therethrough. The first framework includes respective first framework first and second end legs 31 and 32 arranged in a parallel spaced relationship. The first end leg 31 includes respective first and second pulleys 27 and 28 mounted thereto adjacent the respective first and second support legs 11 and 12. The second end leg 32 includes respective third and fourth pulleys 29 and 30 positioned in adjacency relative to the third and fourth support legs 13 and 14. All of the pulleys are arranged to extend below the first framework, as indicated in FIG. 1. Typically, each pulley is pivotally mounted to an associated end leg, in a manner as indicated in FIG. 5, utilizing a pulley hook mounting an associated pulley relative to a flange member. Further, the pulley hooks, as indicated by the designation 46, are arranged for reception within a flange member opening 48 of the associated flange member 47. Each flange member as indicated is fixedly mounted to an associated end leg projecting therebelow, and with each flange member of identical construction relative to an associated pulley having a pulley hook, as indicated.

The first and second pulleys 27 and 28 are mounted to a first flexible lift band 33 having first band first and second ends, with the first band first end mounted to the first pulley, the first band second end mounted to the second pulley. A second flexible lift band 34 is mounted to the third and fourth pulleys, with the second band having second band first and second ends, with the second band first end mounted to the third pulley and the second band second end mounted to the fourth pulley. A first lift rope 35 is wound about the lift shaft 26 and guided along the first pulley 27 and secured to the first band first end. A second lift rope 36 is wound about the lift shaft 26 and guided along the second pulley and thereafter secured first band second end. A third lift rope 37 wound about the lift shaft 26 is guided along the third pulley and secured to the second band first end, with a fourth lift rope 38 wound about the lift shaft 26 then guided along the fourth pulley then secured to the second band second end 34, in a manner as indicated in FIG. 1.

A control wheel 39 is mounted to the lift shaft exteriorly of the first framework. The wheel 39 includes an annular rim 40 having spokes 41 directed from the annular rim to a central hub of the wheel 39 that in turn is mounted to the lift shaft. A lock bar 42 is provided having a lock bar cable 43 wound about the lift shaft exteriorly of the framework, with the lock bar having a lock bar hook, with the lock bar hook support cable 45 mounting the lock bar hook flexibly to the lock bar. Positioning of the lock bar hook about the rim 40 prevents rotation of the wheel upon lifting of a boat and positioning of the boat relative to a body of water, as indicated in FIG. 3.

It should be further noted that the apparatus 10, and more particularly the frameworks 21, 22, as well as the support legs and associated structure, is formed of a thermally transmissive material such as steel and the like to permit transmission of heat therethrough. Such transmission connected along the frameworks and the legs, etc. directs warmer temperature typically found at lower water levels and through the water bottom assisting in the prevention of freezing about the framework structure in use to prevent ice from crushing the framework when position as indicated in FIG. 3 during the wintry months.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A boat lift apparatus, comprising, a first rectilinear framework spaced from and parallel a second rectilinear framework, wherein the first framework is positioned above the second framework, the first framework having a first frame first side leg and a first frame second side leg, a first frame first end leg and a first frame second end leg, and a first support leg, a second support leg, a third support leg, and a fourth support leg are integrally mounted to the first framework and the second framework, with the first support leg, the second support leg, the third support leg, and the fourth support leg arranged in a coextensive relationship relative to one another, and splayed exteriorly of and projecting downwardly of the first framework, and lift means mounted to the first framework, having a first flexible web mounted in adjacency to the first frame first end leg, and a second flexible web mounted in adjacency to the first frame second end leg, the first web oriented parallel to the second web for lifting of a boat from the first framework towards the second framework.

2. An apparatus as set forth in claim 1 wherein the lift means includes a first bearing mounted to the first frame first side leg, and a second bearing mount mounted to the first frame second side leg, with the first bearing mount and the second bearing mount coaxially aligned, and a lift shaft rotatably mounted and extending through the first bearing and the second bearing mount, wherein the lift shaft includes a wheel member mounted to the lift shaft exteriorly of the first frame first side leg, and the first frame first side leg including a first pulley positioned in adjacency relative to the first support leg, a second pulley mounted to the first frame first end leg positioned in adjacency relative to the second support leg, a third pulley mounted to the first frame second end leg in adjacency relative to the third support leg, and a fourth pulley mounted to the first frame second end leg in adjacency relative to the fourth support leg, and a first lift rope wound about the lift shaft and directed along the first pulley and secured to the first web at a first end of the first web, a second lift rope wound about the lift shaft guided along the second pulley and mounted to a second end of the first web, and the second web having a second web first end and a second web second end, with a third lift rope wound about the lift shaft guided along the third pulley and secured to the second web first end, and a fourth rope wound about the lift shaft guided along the fourth pulley and secured to the second web second end, whereupon rotation of the wheel member effects simultaneous displacement of the first web and the second web relative to the first framework and the second framework.

3. An apparatus as set forth in claim 2 wherein each support leg of said first support leg, second support leg, third support leg, and fourth support leg includes a telescoping leg, and each telescoping leg includes a support plate positioned exteriorly of the second rectilinear framework, and each telescoping leg includes a latch member permitting selective and fixed positioning of each foot plate relative to the second rectilinear framework.

4. An apparatus as set forth in claim 3 wherein the first frame first end leg and the first frame second end leg include a plurality of flange members extending below the first rectilinear framework, and each pulley includes a pulley hook for pivotal mounting of each pulley relative to one of said flange members.

5. An apparatus as set forth in claim 4 wherein the wheel member includes an annular rim and a central hub, with the central hub mounted to the lift shaft, and a plurality of spokes extending from the hub to the annular rim, and a lock bar mounted below the wheel member on the first support leg, and a lock bar hook having a lock bar cable extending from the hook to the lock bar, with the hook arranged for selective reception about the annular rim between a plurality of said spokes.

* * * * *